US012655491B2

(12) United States Patent
Cho et al.

(10) Patent No.: US 12,655,491 B2
(45) Date of Patent: Jun. 16, 2026

(54) HIGH STRENGTH STEEL FOR STRUCTURE WITH EXCELLENT CORROSION RESISTANCE AND MANUFACTURING METHOD FOR SAME

(71) Applicant: POSCO, Pohang-si (KR)

(72) Inventors: Jae-Young Cho, Gwangyang-si (KR); Sang-Deok Kang, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 739 days.

(21) Appl. No.: 17/616,396

(22) PCT Filed: Jun. 2, 2020

(86) PCT No.: PCT/KR2020/007148

§ 371 (c)(1),
(2) Date: Dec. 3, 2021

(87) PCT Pub. No.: WO2020/262837

PCT Pub. Date: Dec. 30, 2020

(65) Prior Publication Data

US 2022/0243295 A1 Aug. 4, 2022

(30) Foreign Application Priority Data

Jun. 24, 2019 (KR) ..... 10-2019-0075213

(51) Int. Cl.

| | |
|---|---|
| ***C21D 8/00*** | (2006.01) |
| ***C21D 6/00*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |

(Continued)

(52) U.S. Cl.
CPC ..... *C21D 8/00* (2013.01); *C21D 6/004* (2013.01); *C21D 6/005* (2013.01); *C21D 6/008* (2013.01);

(Continued)

(58) Field of Classification Search
CPC ... C21D 1/06; C21D 1/18; C21D 1/19; C21D 1/60; C21D 1/667; C21D 2211/001;

(Continued)

(56) References Cited

U.S. PATENT DOCUMENTS 5,421,920 A 6/1995 Yamamoto et al.
2005/0013722 A1 1/2005 Usami et al.

(Continued)

FOREIGN PATENT DOCUMENTS

CN 101868560 A 10/2010
CN 102676949 A 9/2012

(Continued)

OTHER PUBLICATIONS

Chinese Office Action dated Mar. 22, 2022 issued in Chinese Patent Application No. 202080045863.4 (with English translation).

(Continued)

*Primary Examiner* — Nicholas A Wang
(74) *Attorney, Agent, or Firm* — Morgan Lewis & Bockius LLP

(57) ABSTRACT

One aspect of the present invention may provide steel having high strength characteristics and excellent corrosion resistance, which is suitable for a structure, and a method for manufacturing same.

5 Claims, 5 Drawing Sheets

(51) Int. Cl.

| | |
|---|---|
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/002* (2013.01); *C21D 2211/005* (2013.01); *C21D 2211/008* (2013.01)

(58) Field of Classification Search
CPC ..... C21D 2211/002; C21D 2211/005; C21D 2211/008; C21D 6/004; C21D 6/005; C21D 6/008; C21D 8/005; C21D 8/0205; C21D 8/0226; C21D 8/0247; C21D 8/0263; C21D 9/0012; C21D 9/0062; C21D 9/46
See application file for complete search history.

(56) References Cited

U.S. PATENT DOCUMENTS

| | | | | |
|---|---|---|---|---|
| 2010/0263773 | A1 | 10/2010 | Cho et al. | |
| 2014/0352852 | A1 | 12/2014 | Nakata et al. | |
| 2016/0017466 | A1* | 1/2016 | Shibata | C21D 6/002 148/333 |
| 2018/0363081 | A1 | 12/2018 | Lee et al. | |
| 2018/0371590 | A1 | 12/2018 | Yu et al. | |
| 2019/0264306 | A1 | 8/2019 | Kim et al. | |
| 2021/0071279 | A1 | 3/2021 | Cho et al. | |

FOREIGN PATENT DOCUMENTS

| | | | | |
|---|---|---|---|---|
| CN | 105121684 | A | | 12/2015 |
| CN | 108070789 | | * | 5/2018 |
| CN | 109923237 | A | | 6/2019 |
| JP | 2001-020035 | A | | 1/2001 |
| JP | 2002-020835 | A | | 1/2002 |
| JP | 2003-213367 | A | | 7/2003 |
| JP | 2008-069380 | A | | 3/2008 |
| JP | WO2015030210 | | * | 3/2015 |
| JP | 2017-160544 | A | | 9/2017 |
| KR | 1996-0009174 | B1 | | 7/1996 |
| KR | 10-0833076 | B1 | | 5/2008 |
| KR | 10-2015-0122779 | A | | 11/2015 |
| KR | 10-1819356 | B1 | | 1/2018 |
| KR | 10-2019-0077183 | A | | 7/2019 |
| WO | 2018/117614 | A1 | | 6/2018 |

OTHER PUBLICATIONS

European Search Report dated Mar. 22, 2023, issued in corresponding European Patent Application No. 20832677.7.
International Search Report dated Nov. 27, 2020 issued in International Patent Application No. PCT/KR2020/007148 (with English translation).

* cited by examiner

【Fig. 1】
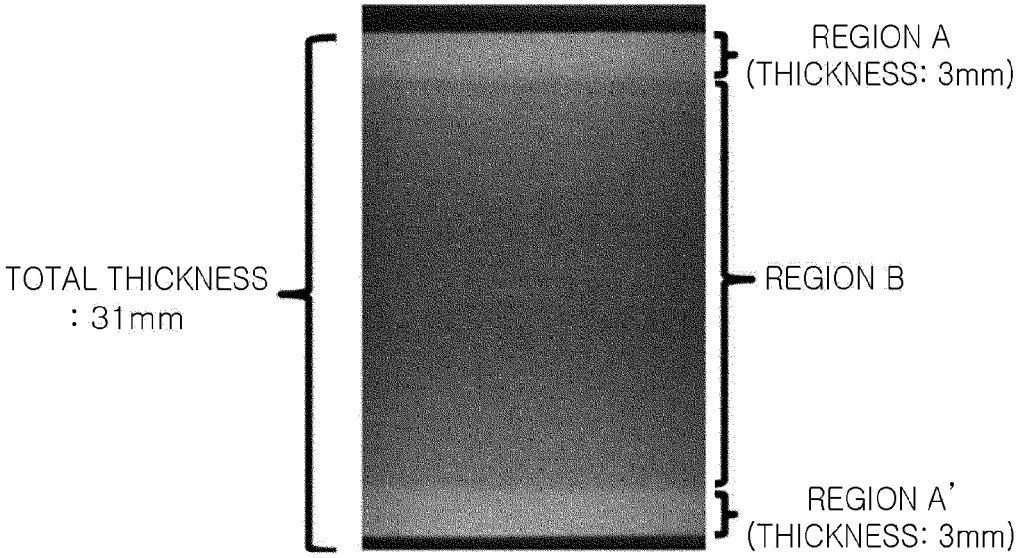

【Fig. 2】
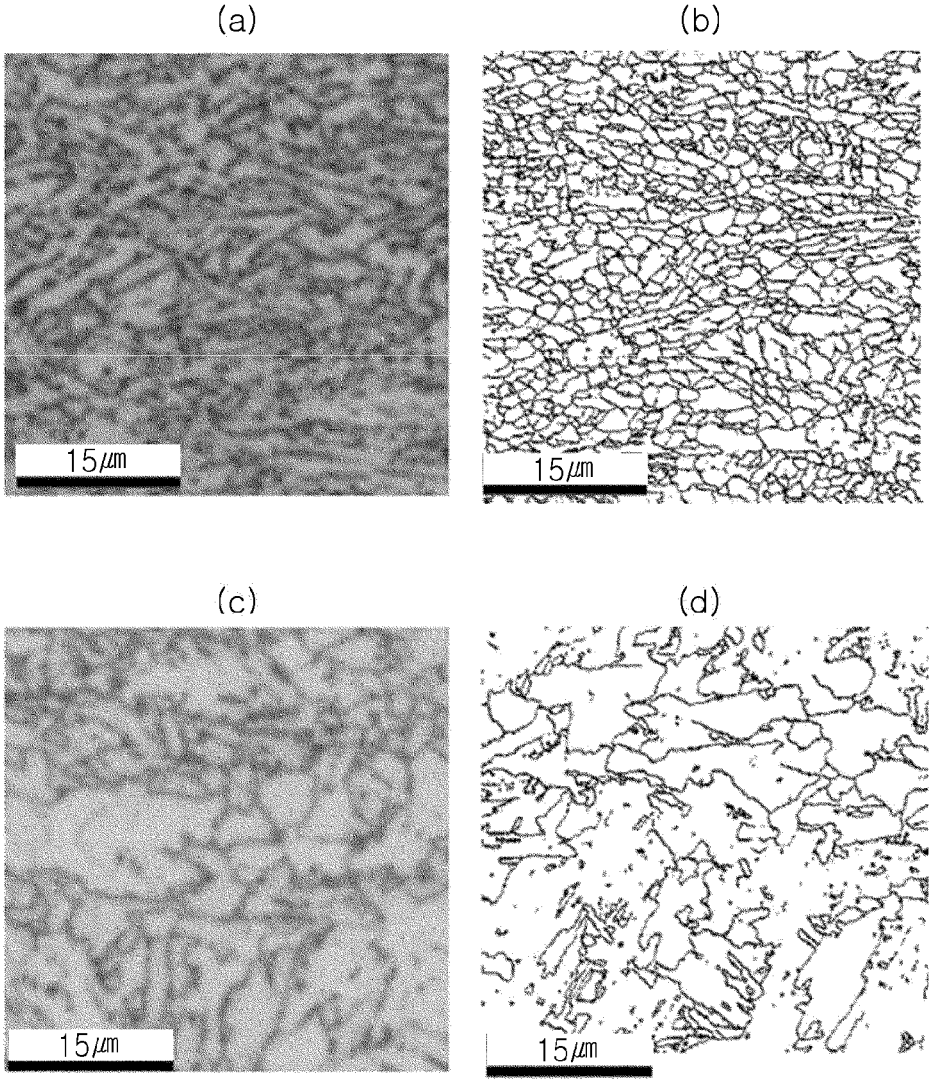

【Fig. 3】
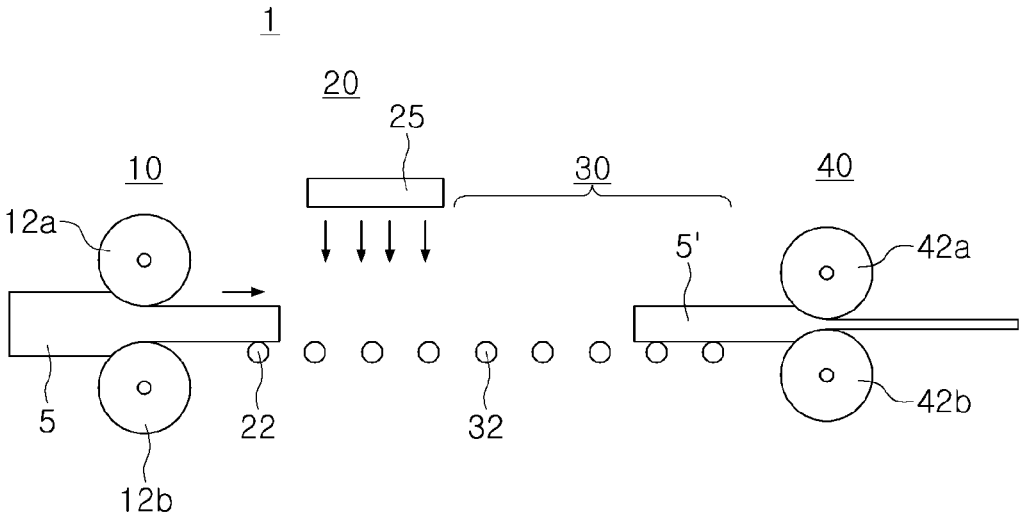
【Fig. 4】
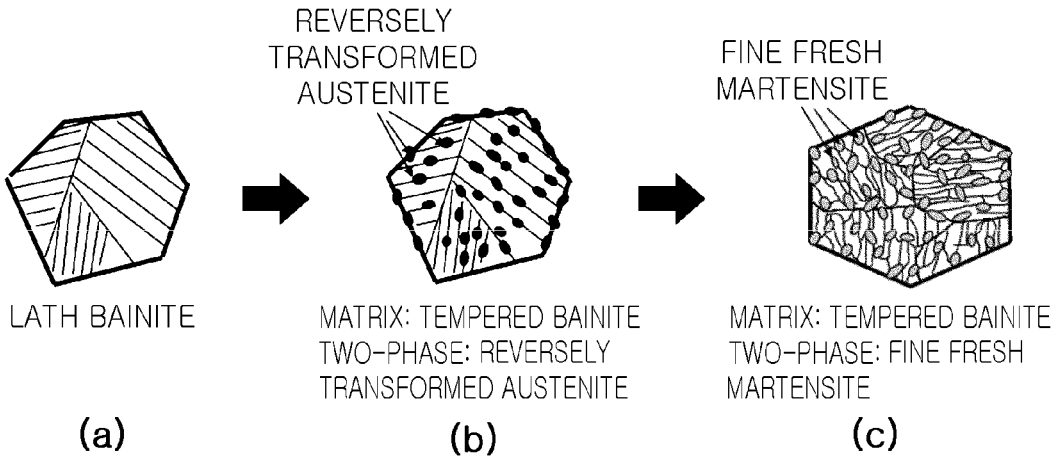

【Fig. 5】
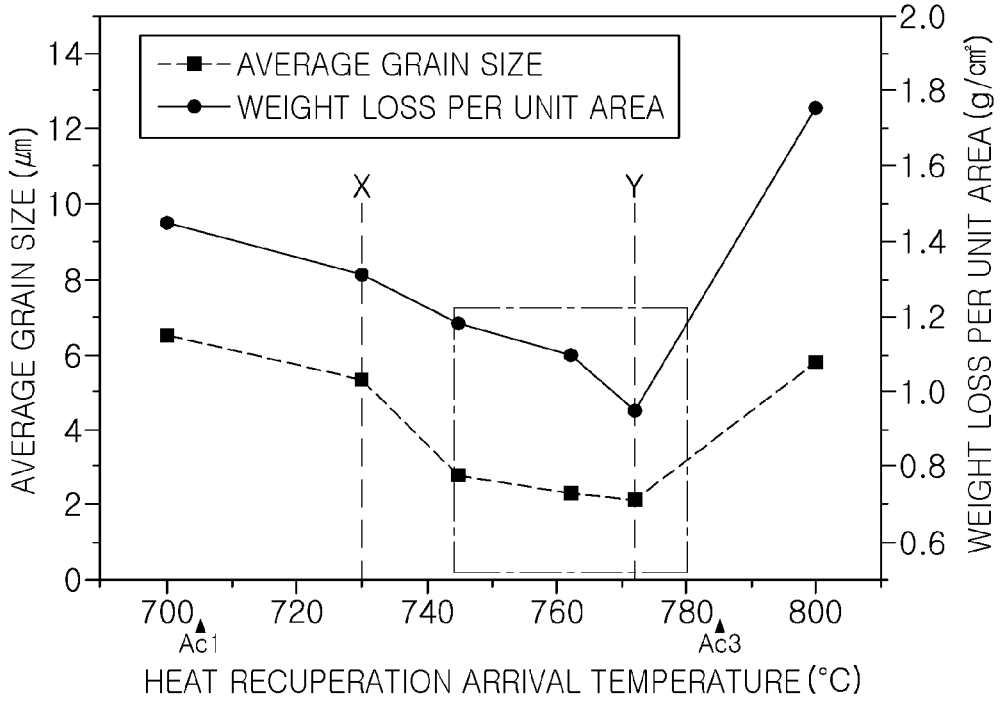

【Fig. 6】
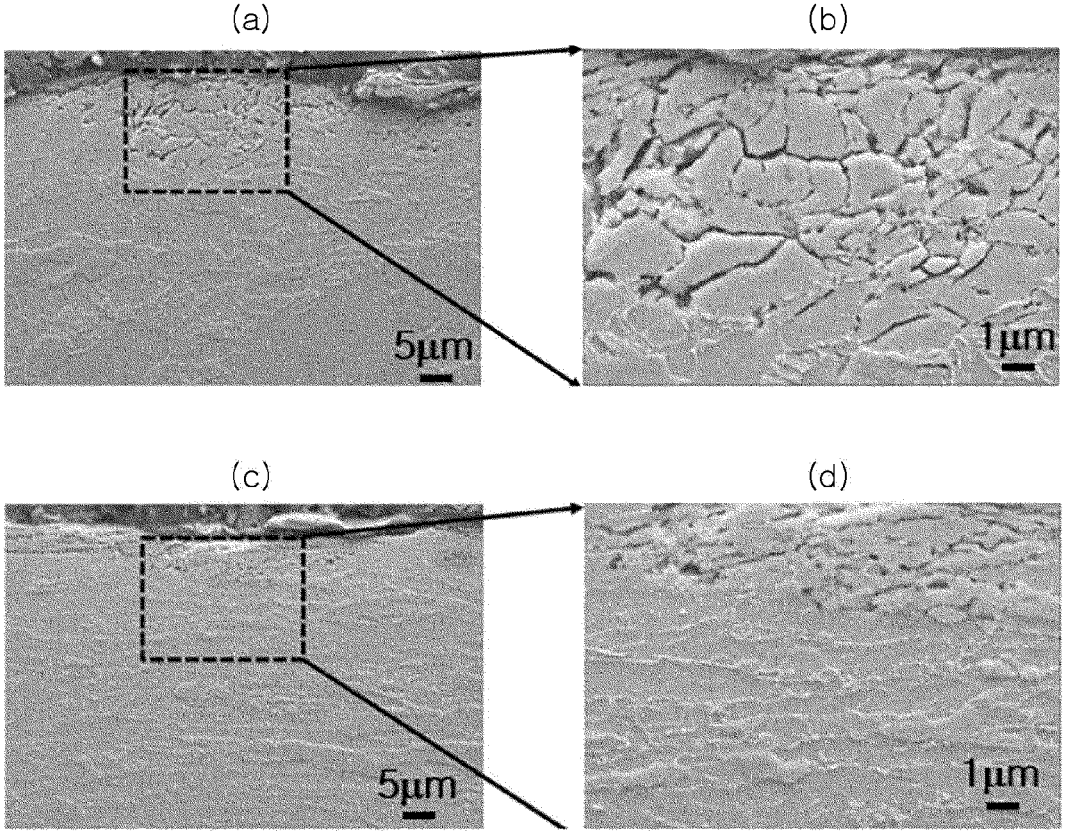

HIGH STRENGTH STEEL FOR STRUCTURE WITH EXCELLENT CORROSION RESISTANCE AND MANUFACTURING METHOD FOR SAME

CROSS-REFERENCE OF RELATED APPLICATIONS

This application is the U.S. National Phase under 35 U.S.C. § 371 of International Patent Application No. PCT/KR2020/007148, filed on Jun. 2, 2020, which in turn claims the benefit of Korean Application No. 10-2019-0075213, filed on Jun. 24, 2019, the entire disclosures of which applications are incorporated by reference herein.

TECHNICAL FIELD

The present disclosure relates to high-strength steel for a structure having excellent corrosion resistance and a method of manufacturing the same, and more particularly, to high-strength steel for a structure having corrosion resistance effectively improved by optimizing a microstructure and a manufacturing process and a method of manufacturing the same.

BACKGROUND ART

Recently, from the viewpoint of environmental issues and life cycle cost (LCC), eco-friendliness and low-cost characteristics have been more required for various structural materials used for shipbuilding, marine, and construction industries. To secure corrosion resistance of steel plates used for structures such as shipbuilding, offshore structures, line pipes, buildings, and bridges, expensive alloying elements such as copper (Cu), chromium (Cr), and nickel (Ni) may be added in the steel plates or sacrificial anodes such as zinc (Zn) and aluminum (Al) may be applied to the steel plates. Therefore, such steel plates may have a certain level of corrosion resistance, but it may difficult for such steel plates to have low-cost characteristics.

In particular, ASTM A 709 requires that a corrosion index defined by the following relational expression in relation to corrosion resistance of carbon steel satisfies 6.0 or more. Therefore, to secure corrosion resistance of a certain level or more, it is essential to add a certain amount or more of Cu, Cr, and Ni.

$$CI=26.01*[Cu]+3.88*[Ni]+1.20*[Cr]+1.49*[Si]+17.28*[P]-7.29*[Cu]*[Ni]-9.1*[Ni]*[P]-33.39*[Cu]^2 \quad \text{[Relational Expression]}$$

where [Cu], [Ni], [Cr], [Si], and [P] refer to weight % of Cu, Ni, Cr, Si, and P, respectively, and refer to 0 when corresponding alloy composition is not included.

Since there is a technical limitation in simultaneously securing corrosion resistance and low-cost characteristics of steel through control of an alloy composition, there have been technical attempts to secure corrosion resistance of steel by controlling a microstructure.

The following patent document 1 proposes a technique for modifying a surface layer structure of steel to secure corrosion resistance characteristics of the steel. However, since the steel of patent document 1 has elongated ferrite as a main structure, the steel cannot have high-strength characteristics of tensile strength of 570 MPa or more. In addition, since heat recuperation may be performed during a rolling process, it may be difficult to strictly control a heat recuperation arrival temperature.

Accordingly, there is a need for urgent research into steel having high-strength characteristics while having both low-cost temperature and corrosion resistance.

PRIOR ART DOCUMENT (Patent Document) Japanese Laid-Open Patent Publication No. 2001-020035 (published on Jan. 23, 2001)

DISCLOSURE

Technical Problem

An aspect of the present disclosure is to provide high-strength steel for a structure having excellent corrosion resistance and a method of manufacturing the same.

The purpose of the present disclosure is not limited to the above description. A person skilled in the art would have no difficulty in understanding the additional purpose of the present disclosure from the overall description in the present specification.

Technical Solution

According to an aspect of the present disclosure, high-strength steel for a structure having excellent corrosion resistance includes, by weight percentage (wt %), carbon (C): 0.03 to 0.12%, silicon (Si): 0.01 to 0.8%, manganese (Mn): 1.6 to 2.4%, phosphorus (P): 0.02% or less, sulfur (S): 0.01% or less, aluminum (Al): 0.005 to 0.5%, niobium (Nb): 0.005 to 0.1%, boron (B): 10 ppm or less, titanium (Ti): 0.005 to 0.1%, nitrogen (N): 15 to 150 ppm, calcium (Ca): 60 ppm or less, and a balance of iron (Fe) and inevitable impurities. The high-strength steel further includes at least one or two or more selected from the group consisting of, by wt %, chromium (Cr): 1.0% or less (including 0%), molybdenum (Mo): 1.0% or less (including 0%), nickel (Ni): 2.0% or less (including 0%), copper (Cu): 1.0% or less (including 0%), and vanadium (V): 0.3% or less (including 0%). A corrosion index (CI) represented by the following equation 1 is 3.0 or less, and weight loss per unit area in a general corrosion acceleration test based on ISO 14993 cyclic corrosion test (CCT) is 1.2 g/cm$^2$, $$CI=26.01*[Cu]+3.88*[Ni]+1.20*[Cr]+1.49*[Si]+17.28*[P]-7.29*[Cu]*[Ni]-9.1*[Ni]*[P]-33.39*[Cu]^2 \quad \text{[Equation 1]}$$

where [Cu], [Ni], [Cr], [Si], and [P] refer to weight % of Cu, Ni, Cr, Si, and P, respectively, and refer to 0 when a corresponding alloy composition is not included.

The high-strength steel may include a surface layer portion, disposed externally on the high-strength steel, and a central portion, disposed internally in the high-strength steel, the surface layer portion and the central portion being microstructurally divided in a thickness direction of the high-strength steel. The surface layer portion may include bainite as a matrix structure, and the central portion may include acicular ferrite as a matrix structure.

The surface layer portion may include an upper surface layer portion, disposed on an upper side of the high-strength steel, and a lower surface layer portion disposed on a lower side of the high-strength steel. Each of the upper surface layer portion and the lower surface layer portion may be provided to have a thickness of 3 to 10% compared with a thickness of the high-strength steel.

The surface layer portion may further include fresh martensite as a second structure, and the tempered bainite and the fresh martensite may be included in the surface layer portion in a total fraction of 95 area % or more.

The surface layer portion may further include austenite as a residual structure, and the austenite may be included in the surface layer portion in a fraction of 5 area % or less.

The acicular ferrite may be included in the central portion in a fraction of 95 area % or more.

An average grain diameter of a microstructure of the surface layer portion may be 3 μm or less (excluding 0 μm).

An average grain diameter of a microstructure of the central portion may be 5 to 20 μm.

Tensile strength of the high-strength steel may be 570 MPa or more.

According to another aspect of the present disclosure, a method of manufacturing high-strength steel for a structure having excellent corrosion resistance may include: reheating a slab to a temperature of 1050 to 1250° C., the slab comprising, by weight percentage (wt %), carbon (C): 0.03 to 0.12%, silicon (Si): 0.01 to 0.8%, manganese (Mn): 1.6 to 2.4%, phosphorus (P): 0.02% or less, sulfur (S): 0.01% or less, aluminum (Al): 0.005 to 0.5%, niobium (Nb): 0.005 to 0.1%, boron (B): 10 ppm or less, titanium (Ti): 0.005 to 0.1%, nitrogen (N): 15 to 150 ppm, calcium (Ca): 60 ppm or less, and a balance of iron (Fe) and inevitable impurities, and further comprising at least one or two or more selected from the group consisting of, by wt %, chromium (Cr): 1.0% or less (including 0%), molybdenum (Mo): 1.0% or less (including 0%), nickel (Ni): 2.0% or less (including 0%), copper (Cu): 1.0% or less (including 0%), and vanadium (V): 0.3% or less (including 0%), wherein a corrosion index (CI) represented by the following equation 1 is 3.0 or less; rough rolling the reheated slab within a temperature range of Tnr to 1150° C. to provide a rough-rolled bar; first cooling the rough-rolled bar to a temperature range of Ms to Bs° C. at a cooling rate of 5° C./sec; heat recuperating the rough-rolled bar such that a surface layer portion of the first-cooled rough-rolled bar is maintained to be reheated in a temperature range of (Ac1+40° C.) to (Ac3-5° C.) by heat recuperation; finish rolling the heat-recuperated rough-rolled bar to provide steel; and second cooling the finish-rolled steel to a temperature of Ms to Bs° C. at a cooling rate of 5° C./sec or more, $$CI=26.01*[Cu]+3.88*[Ni]+1.20*[Cr]+1.49*[Si]+17.28*[P]-7.29*[Cu]*[Ni]-9.1*[Ni]*[P]-33.39*[Cu]^2 \quad \text{[Equation 1]}$$

where [Cu], [Ni], [Cr], [Si], and [P] refer to weight % of Cu, Ni, Cr, Si, and P, respectively, and refer to 0 when corresponding alloy composition is not included.

The first cooling may be performed by applying water cooling immediately after the rough rolling.

The first cooling may be initiated when a temperature of a surface layer portion of the rough-rolled bar is Ae3+100° C. or less.

In the finish rolling, the rough-rolled bar may be finish-rolled in a temperature of Bs to Tnr° C.

In the finish rolling, the rough-rolled bar may be finish-rolled at a cumulative reduction ratio of 50 to 90%.

Advantageous Effects

As set forth above, according to an example embodiment of the present disclosure, steel having high-strength characteristics of tensile strength of 570 MPa or more while having both low-cost characteristics and corrosion resistance and a method of manufacturing the same may be provided.

DESCRIPTION OF DRAWINGS

FIG. 1 is a captured image illustrating a cross-section of steel according to an embodiment of the present disclosure.

FIG. 2 is a captured image illustrating a microstructure of an upper surface layer portion A and a central portion B of the specimen of FIG. 1.

FIG. 3 is a schematic diagram illustrating an example of a facility for implementing a manufacturing method of the present disclosure.

FIG. 4 is a schematic conceptual diagram illustrating a change in a microstructure of a surface layer portion, depending on heat recuperation of the present disclosure.

FIG. 5 is a graph illustrating a relationship between a heat recuperation arrival temperature and an average grain size of a surface layer portion, and weight loss per unit area in a general corrosion acceleration test through an experimental measurement.

FIG. 6 illustrates scanning electron microscope (SEM) images of cross-sections after performing a general corrosion acceleration test on specimens represented by X and Y in FIG. 5.

BEST MODE

The present disclosure relates to high-strength steel for a structure having excellent corrosion resistance and a method of manufacturing the same, and hereinafter, embodiments of the present disclosure will be described. Embodiments of the present disclosure may be modified in various forms, and the scope of the present disclosure should not be construed as being limited to the embodiments described below. The embodiments are provided to further describe the present disclosure to a person skilled in the art to which the present disclosure pertains.

Hereinafter, a steel composition of high-strength steel for a structure having excellent corrosion resistance according to an aspect of the present disclosure will be described in greater detail. Hereinafter, "%" and "ppm" indicating a content of each element may be based on weight unless otherwise indicated.

High-strength steel for a structure having excellent corrosion resistance according to an aspect of the present disclosure may include, by weight percentage (wt %), carbon (C): 0.03 to 0.12%, silicon (Si): 0.01 to 0.8%, manganese (Mn): 1.6 to 2.4%, phosphorus (P): 0.02% or less, sulfur (S): 0.01% or less, aluminum (Al): 0.005 to 0.5%, niobium (Nb): 0.005 to 0.1%, boron (B): 10 ppm or less, titanium (Ti): 0.005 to 0.1%, nitrogen (N): 15 to 150 ppm, calcium (Ca): 60 ppm or less, and a balance of iron (Fe) and inevitable impurities.

Carbon (C): 0.03 to 0.12%

Carbon (C) is an important element to secure hardenability in the present disclosure and is an element which significantly affects formation of an acicular ferrite structure. Therefore, in the present disclosure, a lower limit of a carbon (C) content may be limited to 0.03% to obtain such effects. However, excessive addition of carbon (C) may cause formation of pearlite, rather than formation of acicular ferrite, having a possibility of lowering low-temperature toughness, and thus, in the present disclosure, an upper limit of the carbon (C) content may be limited to 0.12%. Therefore, the carbon (C) content of the present disclosure may be in a range of 0.02 to 0.12%. Furthermore, in the case of a plate material used as a welding structure, an upper limit of the carbon (C) content may be limited to 0.09% to secure weldability.

Silicon (Si): 0.01 to 0.8%

Silicon (Si) is an element used as a deoxidizer and is also an element contributing to improvement of strength and toughness. Therefore, to obtain such effects, in the present disclosure, a lower limit of a silicon (Si) content may be limited to 0.01%. The lower limit of the silicon (Si) content may be, in detail, 0.05%. The lower limit of the silicon (Si) content may be, in further detail, 0.1%. However, an excessive addition of silicon (Si) may reduce low-temperature toughness and weldability, and thus, in the present disclosure, an upper limit of the silicon (Si) content may be limited to 0.8%. The upper limit of the silicon (Si) content may be, in detail, 0.6%. The content of the silicon (Si) content may be, in further detail, 0.5%.

Manganese (Mn): 1.6 to 2.4%

Manganese (Mn) is an element useful for improving strength by solid solution strengthening and is also an element which may economically increase hardenability. Therefore, to obtain such effects, in the present disclosure, a lower limit of a manganese (Mn) content may be limited to 1.6%. The lower limit of the manganese (Mn) content may be limited to, in detail, 1.7%. The lower limit of the manganese (Mn) content may be limited to, in further detail, 1.8%. However, an excessive addition of manganese (Mn) may significantly reduce toughness of a welded portion due to an increase in excessive hardenability, and thus, in the present disclosure, an upper limit of the manganese (Mn) content may be limited to 2.4%. The upper limit of the manganese (Mn) content may be limited to, in detail, 2.35%.

Phosphorus (P): 0.02% or less

Phosphorus (P) is an element contributing to improvement of strength and corrosion resistance, but the content of phosphorus (P) is preferably maintained as low as possible because phosphorus (P) may significantly lower impact toughness. Therefore, the phosphorus (P) content may be 0.02% or less. However, since phosphorus (P) is an impurity inevitably introduced in a steelmaking process, it is not preferable from an economic point of view to control the phosphorus (P) content to a level of less than 0.001%. Therefore, in the present disclosure, the phosphorus (P) content may be in a range of, in detail, 0.001% to 0.02%.

Sulfur (S): 0.01% or less

Sulfur (S) is an element which forms a non-metallic inclusion such as MnS, or the like, to significantly hamper impact toughness, and thus, a sulfur (S) content is preferably maintained as low as possible. Therefore, in the present disclosure, an upper limit of the sulfur (S) content may be limited to 0.01%. However, since sulfur (S) is an impurity inevitably introduced in a steelmaking process, it is not preferable from an economic point of view to control the sulfur (S) content to a level of less than 0.001%. Therefore, in the present disclosure, the sulfur (S) content may be in a range of 0.001 to 0.01%.

Aluminum (Al): 0.005 to 0.5%

Aluminum (Al) is a typical deoxidizer which may economically deoxidize molten steel and is also an element contributing to improvement of strength. Therefore, to achieve such effects, in the present disclosure, a lower limit of an aluminum (Al) content may be limited to 0.0005%. The lower limit of the aluminum (Al) content may be limited to, in detail, 0.01%. The lower limit of the aluminum (Al) content may be limited to, in further detail, 0.02%. However, an excessive addition of aluminum (Al) may cause clogging of a nozzle during continuous casting, and thus, in the present disclosure, an upper limit of the aluminum (Al) content may be limited to 0.5%. The upper limit of the aluminum (Al) content may be limited to, in detail, 0.4%. The upper limit of the aluminum (Al) content may be limited to, in further detail, 0.3%.

Niobium (Nb): 0.005 to 0.1%

Niobium (Nb) is one of the elements playing the most important role in producing TMCP steel and is also an element precipitated in the form of carbide or nitride to significantly contribute to improvement of strength of a base material and a welded portion. In addition, niobium (Nb) dissolved during reheating of a slab may suppress recrystallization of austenite and may suppress transformation of ferrite and bainite to refine a structure. In the present disclosure, a lower limit of a niobium (Nb) content may be limited to 0.005%. The lower limit of the niobium (Nb) content may be limited to, in detail, 0.01%. The lower limit of the niobium (Nb) content may be limited to, in further detail, 0.02%. However, an excessive addition of niobium (Nb) may form coarse precipitates to cause brittle cracking at corners of the steel, and thus, an upper limit of the niobium (Nb) content may be limited to 0.1%. The upper limit of the niobium (Nb) content may be limited to, in detail, 0.08%. The upper limit of the niobium (Nb) content may be limited to, in further detail, 0.06%.

Boron (B): 10 ppm or less (excluding 0 ppm)

Boron (B) is an inexpensive additional element but is also a beneficial element which may effectively increase hardenability even with a small amount of addition. However, boron (B) may be added to achieve such an aim of the present disclosure. A boron (B) content may be, in detail, 0 ppm. The boron (B) content may be, in further detail, 2 ppm. In the present disclosure, an acicular ferrite structure tends to be formed as a matrix structure, but an excessive addition of boron (B) may significantly contribute to formation of bainite, so that a dense acicular ferrite structure cannot be formed. Therefore, in the present disclosure, an upper limit of the boron (B) content may be limited to 10 ppm.

Titanium (Ti): 0.005 to 0.1%

Titanium (Ti) is an element which may significantly suppress growth of crystal grains during reheating to significantly improve low-temperature toughness. Therefore, to obtain such effects, in the present disclosure, a lower limit of a titanium (Ti) content may be limited to 0.005%. The lower limit of the titanium (Ti) content may be limited to, in detail, 0.007%. The lower limit of the titanium (Ti) content may be limited to, in further detail, 0.01%. However, an excessive addition of titanium (Ti) may result in an issue such as clogging of a nozzle in continuous casting or a reduction in low-temperature toughness caused by crystallization of a central portion, and thus, in the present disclosure, an upper limit of the titanium (Ti) content may be limited to 0.1%. The upper limit of the titanium (Ti) content may be limited to, in detail, 0.07%. The upper limit of the titanium (Ti) content may be limited to, in further detail, 0.05%.

Nitrogen (N): 15 to 150 ppm

Nitrogen (N) is an element contributing to improvement of strength of the steel. Therefore, an upper limit of a nitrogen (N) content may be limited to 150 ppm. However, nitrogen (N) is an impurity inevitably introduced in the steelmaking process, and it is not preferable from the economical point of view to control the nitrogen (N) content to a level of less than 15 ppm. Therefore, in the present disclosure, the nitrogen (N) content may be in a range of, in detail, 15 to 150 ppm.

Calcium (Ca): 60 ppm or less

Calcium (Ca) is mainly used as an element controlling a shape of a non-metallic inclusion, such as MnS or the like, and improving low-temperature toughness. However, an excessive addition of calcium (Ca) may cause formation of a large amount of CaO—CaS and formation of a coarse inclusion, which may lower cleanliness of the steel and weldability in the field. Therefore, in the present disclosure, an upper limit of the calcium (Ca) content may be limited to 60 ppm.

The high-strength steel for a structure having excellent corrosion resistance according to an aspect of the present disclosure may include at least one or two or more selected from the group consisting of, by weight percentage (wt %), chromium (Cr): 1.0% or less (including 0%), molybdenum (Mo): 1.0% or less (including 0%), nickel (Ni): 2.0% or less (including 0%), copper (Cu): 1.0% or less (including 00), and vanadium (V): 0.3% or less (including 00).

Chromium (Cr): 1.0% or less (including 0%)

Chromium (Cr) is an element which effectively contributes to an increase in strength by increasing hardenability, and thus, in the present disclosure, a certain amount of chromium (Cr) may be added to achieve such an effect. When chromium (Cr) is included, a lower limit of a chromium (Cr) content may be 0.01%. However, when chromium (Cr) is excessively added, it is not preferable in terms of cost competitiveness and weldability may be significantly reduced. Therefore, in the present disclosure, an upper limit of the chromium (Cr) content may be limited to 1.0%.

Molybdenum (Mo): 1.0% or less (including 0%)

Molybdenum (Mo) is an element which may significantly improve hardenability even with a small amount of addition and may suppress formation of ferrite to significantly improve strength of the steel. Therefore, molybdenum (Mo) may be added in a certain amount in terms of ensuring strength. When molybdenum (Mo) is added, a lower limit of a molybdenum (Mo) content may be, in detail, 0.01%. However, an excessive addition of the molybdenum (Mo) may result in an excessive increase in hardness of a welded portion and a decrease in toughness of a base material, and thus, in the present disclosure, an upper limit of the molybdenum (Mo) content may be limited to 1.0%.

Nickel (Ni): 2.0% or less (including 0%)

Nickel (Ni) is almost the only element which may simultaneously improve strength and toughness of a base material, and thus, in the present disclosure, nickel (Ni) may be added in a certain amount to achieve such effects. When nickel (Ni) is added, a lower limit of a nickel (Ni) content may be 0.01%. However, nickel (Ni) is an expensive element, and an excessive addition thereof is not preferable from the economical point of view. When nickel (Ni) is excessively added, weldability may be degraded. Therefore, in the present disclosure, an upper limit of the nickel (Ni) content is limited to 2.0%.

Copper (Cu): 1.0% or less (including 0%)

Copper (Cu) is an element which may increase strength while significantly reducing deterioration of toughness of a base material. Therefore, in the present disclosure, copper (Cu) may be added in a certain amount to achieve such effects. When copper (Cu) is added, a lower limit of a copper (Cu) content may be, in detail, 0.01%. However, an excessive addition of copper (Cu) may cause quality of an end product to be deteriorated, and thus, in the present disclosure, an upper limit of the copper (Cu) content may be limited to 1.0%.

Vanadium (V): 0.3% or less (including 0%)

Vanadium (V) is an element which has a lower solid-solution temperature than other alloy compositions and may be precipitated in a welding heat-affected portion to prevent a reduction in strength of a welded portion. Therefore, in the present disclosure, vanadium (V) may be added in a certain amount to achieve such an effect. When vanadium (V) is added, a lower limit of a vanadium (V) content may be, in detail, 0.005%. However, when vanadium (V) is excessively added, toughness may be deteriorated, and thus, in the present disclosure, an upper limit of the vanadium (V) content may be limited to 0.3%.

In addition, the high-strength steel for a structure having excellent corrosion resistance according to an aspect of the present disclosure may have a corrosion index (CI) of 3.0 or less, represented by the following Equation 1.

$$CI=26.01*[Cu]+3.88*[Ni]+1.20*[Cr]+1.49*[Si]+17.28*[P]-7.29*[Cu]*[Ni]-9.1*[Ni]*[P]-33.39*[Cu]^2 \quad \text{[Equation 1]}$$

where [Cu], [Ni], [Cr], [Si], and [P] refer to weight % of Cu, Ni, Cr, Si, and P, respectively, and 0 is substituted when a corresponding alloy composition is not included.

In the high-strength steel for a structure having excellent corrosion resistance according to an aspect of the present disclosure, as described above, the ranges of the contents of copper (Cu), nickel (Ni), chromium (Cr), silicon (Si), and phosphorus (P) may be individually limited. However, even when some of the above-mentioned elements are added, the range of the contents of copper (Cu), nickel (Ni), chromium (Cr), silicon (Si), and phosphorus (P) may be relatively limited such that the corrosion index (CI), calculated as in the above equation 1, is 3.0 or less.

For example, the corrosion index (CI) calculated by the above equation 1 may be generally required to be 6.0 or more to secure corrosion resistance of carbon steel. However, in the present disclosure, the same or superior corrosion resistance may be secured through control of a microstructure even when the corrosion resistance (CI) calculated by the above equation 1 is at a level of 3.0 or less. Therefore, the high-strength steel for a structure having excellent corrosion resistance according to an aspect of the present disclosure may secure corrosion resistance of a certain level or higher through the control of microstructure while suppressing the addition of Cu, Ni, Cr, and the like, and thus, may simultaneously secure corrosion resistance and low-cost characteristics.

In the present disclosure, the balance, other than the steel composition, may be iron (Fe) and inevitable impurities. The inevitable impurities, which may be unintentionally incorporated in a general steel manufacturing process, cannot be completely excluded, which may be easily understood by those skilled in the general steel manufacturing field. In addition, in the present disclosure, an addition of other compositions than the steel compositions mentioned above is not completely excluded.

The high-strength steel for a structure having excellent corrosion resistance according to an aspect of the present disclosure is not limited in thickness, but may be a thick steel plate for a structure having a thickness of, in detail, 10 mm or more, and may be a thick steel plate for a structure having a thickness of, in further detail, 20 to 100 mm.

Hereinafter, a microstructure of the high-strength steel for a structure having excellent corrosion resistance according to an aspect of the present invention will be described in more detail.

The high-strength structural steel having excellent corrosion resistance according to an aspect of the present invention may be divided into a surface layer portion, microstructurally divided, on a steel surface side, and a central portion disposed between surface layer portions. The surface layer portion may be divided into an upper surface layer portion on an upper side of the steel and a lower surface layer portion on a lower side of the steel, and each of the upper surface layer portion and the lower surface layer portion may be provided to have a thickness of 3 to 10% of a thickness "t" of the steel.

The surface layer portion may include tempered bainite as a matrix structure, and may include fresh martensite and austenite as a second structure and a residual structure, respectively. A total fraction of tempered bainite and fresh martensite in the surface layer portion may be 95 area % or more, and a fraction of an austenite structure in the surface layer portion may be 5 area % or less. A fraction of the austenite structure in the surface layer portion may be 0 area %.

The central portion may include acicular ferrite as a matrix structure, and a fraction of acicular ferrite in the central portion may be 95 area % or more.

An average grain size of the microstructure of the surface layer portion may be 3 μm or less (excluding 0 μm), and an average grain size of the microstructure of the central portion may be 5 to 20 μm. The average grain size of the microstructure of the surface layer portion may refer to a case in which an average grain size of each of tempered bainite, fresh martensite, and austenite is 3 μm or less (except 0 μm), and the average grain size of the microstructure of the central portion may refer to a case in which an average grain size of acicular ferrite is 5 to 20 μm. The average grain size of the microstructure of the central portion may be, in detail, 10 to 20 μm.

FIG. 1 is a captured image illustrating a cross-section of steel according to an embodiment of the present disclosure.

Referring to FIG. 1, it can be seen that a steel specimen according to an embodiment is divided into upper and lower surface layer portions A and A' on upper and lower surface sides and a central portion B between the upper and lower surface layer portions A and A', and a boundary between the upper and lower surface layer portions A and A' may be readily distinguished with the naked eye. For example, it can be seen that the upper and lower surface layer portions A and A' and the central portion B of the steel according to an embodiment of the present disclosure are clearly microstructurally distinguished.

FIG. 2 is a captured image illustrating a microstructure of an upper surface layer portion A and a central portion B of the specimen of FIG. 1. FIGS. 2A and 2B are an image of the upper surface layer portion A of the specimen observed with an optical microscope and a high-angle grain boundary map captured using EBSD for the upper surface layer portion A of the specimen, respectively. FIGS. 2C and 2D are an image of the central portion B of the specimen observed with an optical microscope and a high-angle grain boundary map captured using EBSD for the central portion B of the specimen, respectively.

As can be seen in FIGS. 2A to 2D, the upper surface layer portion A includes tempered bainite and fresh martensite having an average grain size of about 3 μm or less, while the central portion B may includes acicular ferrite having an average grain size of about 15 μm.

In the steel according to one aspect of the present disclosure, a surface layer structure may be refined by reheating. Therefore, an average grain size of a microstructure of the surface layer portion may be 3 μm or less, and weight loss per unit area in a general corrosion acceleration test based on ISO 14993 Cyclic Corrosion Test (CCT) method may be 1.2 $g/cm^2$ or less. In addition, since the steel according to an aspect of the present disclosure has tensile strength of 570 MPa or more, high-strength characteristics may be effectively secured while securing corrosion resistance and low-cost characteristics.

Hereinafter, a method of manufacturing high-strength steel for a structure having excellent corrosion resistance according to an aspect of the present disclosure will be described in more detail.

Slab Reheating

Since a slab prepared in the manufacturing method according to the present disclosure has a steel composition corresponding to the steel composition of the above-described steel, a description of the steel composition of the slab will be replaced with the description of the steel composition of the above-described steel.

The slab prepared with the above-described steel composition may be reheated in a temperature range of 1050 to 1250° C. A lower limit of the reheating temperature of the slab may be limited to 1050° C. to sufficiently dissolve carbonitride of titanium (Ti) and niobium (Nb) formed during casting. However, when the reheating temperature is excessively high, austenite may be likely to be coarsened, and it may take an excessive amount of time for a surface layer temperature of a rough-rolled bar to reach a first cooling start temperature after rough rolling. Therefore, an upper limit of the reheating temperature may be limited to 1250° C.

Rough Rolling

After the reheating, rough rolling may be performed to adjust a shape of the slab and to break a cast structure such as dendrite, or the like. The rough rolling may be performed at, in detail, a temperature Tnr (° C.) at which recrystallization of austenite is stopped, and an upper limit of the first cooling may be limited to, in detail, 1150° C. in consideration of the cooling start temperature of the first cooling. In addition, the rough rolling of the present disclosure may be performed under the condition of a cumulative reduction ratio of 20 to 70%.

First Cooling

After the rough rolling is finished, first cooling may be performed to form lath bainite on the surface layer of the rough rolled bar. A cooling rate of the first cooling may be, in detail, 5° C./sec or more, and a cooling arrival temperature of the first cooling may be in a temperature range of Ms to Bs ° C. When the cooling rate of the first cooling is less than a certain level, a polygonal ferrite or granular bainite structure, rather than a lath bainite structure, may be formed in a surface layer portion. Therefore, in the present disclosure, the cooling rate may be limited to 5° C./sec or more. In addition, a cooling method in the first cooling is not limited but may be, in detail, water cooling in terms of cooling efficiency. When the cooling start temperature of the first cooling is excessively high, a lath bainite structure formed in the surface layer portion by the first cooling may be likely to be coarsened. Therefore, a start temperature of the first cooling may be limited to, in detail, Ae3+100° C. or less. In the first cooling, the cooling rate, the cooling start temperature, and the cooling arrival temperature may be based on a temperature of a central portion of the rough-rolled bar.

In the present disclosure, the first cooling may be performed, in detail, immediately after the rough rolling to significantly increase an effect of heat recuperation. FIG. 3 is a schematic diagram illustrating an example of a facility 1 for implementing a manufacturing method of the present disclosure. A rough-rolling device 10, a cooling device 20, a heat recuperator 30, and a finish-rolling device 40 may be sequentially arranged on a movement path of the slab 5, and the rough-rolling device 10 and the finish-rolling device 40 may include rough-rolling rollers 12*a* and 12*b* and finish-rolling rollers 42*a* and 42*b*, respectively, to roll the slab 5 and the rough-rolled bar 5'. The cooling device 20 may include a bar cooler 25, spraying cooling water, and an auxiliary roller 22 guiding a movement of the rough-rolled slab 5'. The bar cooler 25 may be disposed, in detail, in an immediate rear of the rough-rolling device 10 in terms of significant increasing a heat recuperation effect. The heat recuperator 30 may disposed in the rear of the cooling device 20, and the rough-rolled slab 5 may be heat-recuperated while moving along an auxiliary roller 32. The heat-recuperated slab 5' may be moved to the finish-rolling device 40 to be finish-rolled. Such a facility 1 is merely an example of a facility for carrying out the present disclosure, and the present disclosure should not be interpreted as being manufactured by the facility illustrated in FIG. 6.

Heat Recuperation

After the first cooling, heat recuperation may be performed to allow a side of the surface layer portion of the rough-rolled bar to be reheated by high heat on a side of the central portion of the rough-rolled bar. The heat recuperation may be performed until a temperature of the surface layer portion of the rough-rolled bar reaches (Ac1+40° C.) to (Ac3−5° C.). By the heat recuperation, the lath bainite of the surface layer portion may be transformed into fine tempered bainite and fresh martensite, and a portion of the lath bainite of the surface part may be reversely transformed into austenite.

FIG. 4 is a schematic conceptual diagram illustrating a change in a microstructure of a surface layer portion, depending on heat recuperation of the present disclosure.

As illustrated in FIG. 4A, a microstructure of the surface layer portion immediately after the first cooling may be provided as a lath bainite structure. As illustrated in FIG. 4B, as heat recuperation is performed, lath bainite of the surface layer portion may be transformed into a tempered bainite structure and a portion of the lath bainite of the surface layer portion may be reversely transformed into austenite. As the finish rolling and the second cooling are performed after the heat recuperation, as illustrated in FIG. 4C, a two-phase mixed structure of tempered bainite and fresh martensite may be formed and a portion of the austenite structure may remain.

FIG. 5 is a graph illustrating a relationship between a heat recuperation arrival temperature and an average grain size of a surface layer portion, and weight loss per unit area in a general corrosion acceleration test through an experimental measurement. Specimens were manufactured under conditions satisfying the alloy composition and the manufacturing method of the present disclosure, but experiments were conducted while varying a heat recuperation arrival temperature during heat recuperation. In this case, an average grain size of a surface layer portion was measured based on EBSD, and a general corrosion acceleration test was conducted based on the ISO 14993 Cyclic Corrosion Test (CCT). For example, the accelerated corrosion test based on the ISO 14993 CCT was performed for 120 cycles (40 days), each including "salt spray (5% of NaCl, 35° C., 2 hours)$^{-4}$ drying (60° C., 4 hours)$^{-4}$ wetting (60° C., 4 hours)," and a difference between a weight of an initial specimen and a weight of a final specimen was measured to evaluate loss of corrosion.

Referring to FIG. 5, it can be seen that when an arrival temperature of the surface layer portion is less than (Ac1+40° C.), an average grain size of the surface layer portion exceeds 3 μm and weight loss per unit area in the general corrosion acceleration test exceeds 1.2 g/cm$^2$. In addition, it can be seen that when the arrival temperature of the surface layer portion exceeds (Ac3-5° C.), the average grain size of the surface layer portion also exceeds 3 μm and weight loss per unit area in the general corrosion acceleration test exceeds 1.2 g/cm$^2$.

FIGS. 6A and 6B is a scanning electron microscope (SEM) image of a cross-section after performing a general corrosion acceleration test on a specimen represented by X in FIG. 5, and FIGS. 6C and 6D are a scanning electron microscope (SEM) image of a cross-section after performing a general corrosion acceleration test on a specimen represented by Y in FIG. 5

As illustrated in FIGS. 6A to 6D, it can be seen that in the case of the specimen X in which an average grain size of a surface layer portion is greater than 3 μm, a large amount of scale was formed on a grain boundary of a surface layer portion structure, whereas in the case of the specimen Y in which an average grain size of a surface layer portion is 3 μm or less, not only a relatively small amount of scale was formed on a grain boundary of a surface layer portion structure, but also the small amount of scale formed was distributed only on a surface side of the steel. For example, it can be seen that in the case of the specimen Y in which the average grain size of the surface layer portion is 3 μm or less, the grain boundary on a surface side of the steel was densely formed to suppress diffusion of scale toward a central portion of the steel, whereas in the case of the specimen Y in which the average grain size of the surface layer portion is greater than 3 μm, the grain boundary on the surface side of the steel was relatively coarsely formed to easily diffuse the scale toward the central portion of the steel.

Finish Rolling

Finish rolling may be performed to introduce a non-uniform microstructure into the austenite structure of the rough-rolled bar. The finish rolling may be performed within a temperature range higher than or equal to the bainite transformation start temperature Bs and lower than or equal to an austenite recrystallization temperature Tnr.

Second Cooling

After the finish rolling terminates, cooling may be performed at a cooling rate of 5° C./sec or higher to form an acicular ferrite structure in the central portion of the steel. The second cooling method is not limited but, in detail, water cooling may be employed from the viewpoint of cooling efficiency. If an arrival temperature of the second cooling is higher Bs° C. based on the steel, the structure of the acicular ferrite may be coarsened and an average grain diameter of the acicular ferrite may be greater than 20 μm. In addition, when the arrival temperature of the second cooling is lower than Ms° C. based on the steel, there may be a possibility that the steel is twisted, and thus, the arrival temperature of the second cooling is limited to, in detail, Ms to Bs° C. The cooling rate and the cooling arrival temperature in the second cooling may be based on the temperature of the central portion of the steel.

DESCRIPTION OF REFERENCE NUMERALS

1: FACILITY FOR MANUFACTURING STEEL
10: ROUGH-ROLLING DEVICE
12A, 12B: ROUGH-ROLLING ROLLER
20: COOLING DEVICE
22: AUXILIARY ROLLER
25: BAR ROLLER
30: HEAT RECUPERATOR
32: AUXILIARY ROLLER
40: FINISH-ROLLING DEVICE
42A, 42B: FINISH-ROLLING ROLLER

MODE FOR INVENTION

Hereinafter, high-strength steel for a structure having excellent corrosion resistance according to an aspect of the present disclosure and a method of manufacturing the same will be described in more detail through examples.

Example

Slabs having steel compositions of Table 1 below were prepared, and transformation temperatures and corrosion indices (CI) of the slabs based on Table 1 were calculated and listed in Table 2.

TABLE 1

| STEEL | ALLOY COMPOSITION (wt %, however, the unit of B, N and Ca is ppm) | | | | | | | | | | | | | | | |
|---|---|---|---|---|---|---|---|---|---|---|---|---|---|---|---|---|
| TYPE | C | Si | Mn | P | S | Al | Ni | Cu | Cr | Mo | Ti | Nb | V | B* | N* | Ca* |
| A | 0.075 | 0.26 | 1.8 | 0.009 | 0.004 | 0.028 | 0.1 | 0.08 | 0.05 | 0.02 | 0.015 | 0.02 | 0.1 | 5 | 41 | 11 |
| B | 0.052 | 0.19 | 1.85 | 0.001 | 0.004 | 0.027 | 0.1 | 0.03 | 0.06 | 0.03 | 0.013 | 0.03 | 0 | 3 | 35 | 15 |
| C | 0.067 | 0.25 | 2.05 | 0.012 | 0.002 | 0.023 | 0.05 | 0.03 | 0.1 | 0 | 0.015 | 0.04 | 0.15 | 9 | 45 | 0 |
| D | 0.07 | 0.35 | 2 | 0.013 | 0.003 | 0.035 | 0 | 0.03 | 0.04 | 0.2 | 0.019 | 0.04 | 0.05 | 10 | 41 | 4 |
| E | 0.031 | 0.27 | 2.35 | 0.013 | 0.002 | 0.03 | 0.1 | 0 | 0 | 0.05 | 0.018 | 0.03 | 0.2 | 7 | 43 | 0 |
| F | 0.015 | 0.23 | 1.55 | 0.014 | 0.002 | 0.035 | 0 | 0 | 0 | 0 | 0.012 | 0.03 | 0 | 8 | 38 | 3 |
| G | 0.15 | 0.34 | 0.9 | 0.013 | 0.001 | 0.04 | 0 | 0.02 | 0 | 0 | 0.016 | 0.03 | 0 | 3 | 35 | 10 |
| H | 0.082 | 0.32 | 1.3 | 0.011 | 0.003 | 0.024 | 0.2 | 0.05 | 0.15 | 0.05 | 0.012 | 0.04 | 0.02 | 2 | 32 | 8 |
| I | 0.075 | 0.27 | 1.26 | 0.016 | 0.004 | 0.03 | 0 | 0 | 0 | 0.07 | 0.01 | 0.04 | 0 | 1 | 50 | 7 |

TABLE 2

| STEEL | TEMPERATURE (° C.) | | | | | EQUATION 1 |
|---|---|---|---|---|---|---|
| TYPE | Bs | Tnr | Ms | Ac3 | Ac1 | CI |
| A | 639 | 891 | 450 | 800 | 710 | 2.8 |
| B | 639 | 946 | 458 | 801 | 708 | 1.5 |
| C | 619 | 1,000 | 446 | 800 | 709 | 1.6 |
| D | 612 | 938 | 447 | 794 | 712 | 1.5 |
| E | 602 | 957 | 452 | 808 | 704 | 1.0 |
| F | 686 | 917 | 486 | 820 | 713 | 0.6 |
| G | 709 | 946 | 448 | 788 | 723 | 1.2 |
| H | 669 | 941 | 459 | 808 | 718 | 2.7 |
| I | 691 | 974 | 468 | 804 | 717 | 0.7 |

The slabs having the compositions of Table 1 were subjected to rough rolling, first cooling, and heat recuperation under the conditions of Table 3 below and subjected to finish rolling and second cooling under the conditions of Table 4. Evaluation results of the steels manufactured under the conditions of Table 3 and Table 4 are listed in Table 5 below.

For each steel, an average grain diameter, mechanical properties, and weight loss per unit area in a general corrosion acceleration test were measured. A grain diameter was measured in a 500 m×500 m region at 0.5 m step size with an electron back scattering diffraction (EBSD) method, a grain boundary map with a crystal orientation difference of 15 degrees or more with adjacent particles was created, and the average grain diameters and high angle grain boundary fractions were obtained. Yield strength YS and tensile strength TS were obtained by testing tension of three specimens in a plate width direction to obtain an average value, and the weight loss per unit area was measured by the above-mentioned ISO 14933 Cyclic Corrosion Test (CCT).

TABLE 3

| | | REHEATING AND ROUGH ROLLING | | | | HEAT RECUPERATION HEAT | |
|---|---|---|---|---|---|---|---|
| STEEL TYPE | CLASSIFICATION | THICKNESS OF SLAB BEFORE ROUGH ROLLING (mm) | RE-HEATING EXTRACTION TEMPERATURE (° C.) | ROUGH ROLLING ENDING TEMPERATURE (° C.) | FIRST COOLING COOLING ENDING TEMPERATURE (° C.) | RECUPERATION ARRIVAL SURFACE TEMPERATURE (° C.) | REMARK |
| A | A-1 | 255 | 1080 | 1000 | 545 | 777 | RECOMMENDED CONDITION |
| | A-2 | 285 | 1075 | 980 | 521 | 774 | RECOMMENDED CONDITION |
| | A-3 | 285 | 1100 | 995 | 461 | 772 | RECOMMENDED CONDITION |
| | A-4 | 264 | 1110 | 1070 | 647 | 855 | EXCEEDING HEAT RECUPERATION TEMPERATURE |
| | A-5 | 250 | 1125 | 950 | 421 | 701 | LESS THAN HEAT RECUPERATION TEMPERATURE |
| | A-6 | 230 | 1050 | 1020 | 531 | 785 | RECOMMENDED CONDITION |
| B | B-1 | 295 | 1070 | 970 | 555 | 776 | RECOMMENDED CONDITION |
| | B-2 | 285 | 1080 | 955 | 550 | 761 | RECOMMENDED CONDITION |
| | B-3 | 225 | 1105 | 1035 | 546 | 774 | RECOMMENDED CONDITION |

TABLE 3-continued

| STEEL TYPE | CLASSIFICATION | REHEATING AND ROUGH ROLLING: THICKNESS OF SLAB BEFORE ROUGH ROLLING (mm) | REHEATING AND ROUGH ROLLING: RE-HEATING EXTRACTION TEMPERATURE (° C.) | REHEATING AND ROUGH ROLLING: ROUGH ROLLING ENDING TEMPERATURE (° C.) | FIRST COOLING COOLING ENDING TEMPERATURE (° C.) | HEAT RECUPERATION HEAT RECUPERATION ARRIVAL SURFACE TEMPERATURE (° C.) | REMARK |
|---|---|---|---|---|---|---|---|
| | B 4 | 254 | 1100 | 1080 | 655 | 857 | EXCEEDING HEAT RECUPERATION TEMPERATURE |
| | B-5 | 240 | 1075 | 990 | 435 | 710 | LESS THAN HEAT RECUPERATION TEMPERATURE |
| C | C-1 | 264 | 1085 | 1010 | 555 | 779 | RECOMMENDED CONDITION |
| | C-2 | 280 | 1065 | 1005 | 530 | 777 | RECOMMENDED CONDITION |
| | C-3 | 265 | 1110 | 1085 | 663 | 871 | EXCEEDING HEAT RECUPERATION TEMPERATURE |
| | C-4 | 275 | 1060 | 1010 | 420 | 723 | LESS THAN HEAT RECUPERATION TEMPERATURE |
| | C-5 | 270 | 1085 | 1030 | 480 | 780 | RECOMMENDED CONDITION |
| D | D-1 | 285 | 1080 | 980 | 515 | 769 | RECOMMENDED CONDITION |
| | D-2 | 265 | 1070 | 990 | 480 | 765 | RECOMMENDED CONDITION |
| | D-3 | 250 | 1100 | 1040 | 620 | 807 | EXCEEDING HEAT RECUPERATION TEMPERATURE |
| | D-4 | 260 | 1020 | 950 | 410 | 703 | LESS THAN HEAT RECUPERATION TEMPERATURE |
| E | E-1 | 265 | 1085 | 985 | 563 | 771 | RECOMMENDED CONDITION |
| | E-2 | 290 | 1075 | 990 | 515 | 780 | RECOMMENDED CONDITION |
| | E-3 | 280 | 1110 | 990 | 525 | 776 | RECOMMENDED CONDITION |
| F | F-1 | 255 | 1090 | 1000 | 561 | 774 | RECOMMENDED CONDITION |
| G | G-1 | 265 | 1090 | 990 | 568 | 776 | RECOMMENDED CONDITION |
| H | H-1 | 290 | 1080 | 950 | 570 | 761 | RECOMMENDED CONDITION |
| I | I-2 | 295 | 1080 | 990 | 500 | 780 | RECOMMENDED CONDITION |

TABLE 4

| STEEL TYPE | CLASSIFICATION | FINISH ROLLING: ROLLING START TEMPERATURE (° C.) | FINISH ROLLING: ROLLING ENDING TEMPERATURE (° C.) | SECOND COOLING: COOLING RATE (° C./s) | SECOND COOLING: COOLING ENDING TEMPERATURE (° C.) | REMARK |
|---|---|---|---|---|---|---|
| A | A-1 | 890 | 850 | 6 | 520 | RECOMMENDED CONDITION |
| | A-2 | 875 | 835 | 18 | 590 | RECOMMENDED CONDITION |

TABLE 4-continued

| STEEL TYPE | CLASSIFICATION | FINISH ROLLING ROLLING START TEMPERATURE (° C.) | FINISH ROLLING ROLLING ENDING TEMPERATURE (° C.) | SECOND COOLING COOLING RATE (° C./s) | SECOND COOLING COOLING ENDING TEMPERATURE (° C.) | REMARK |
|---|---|---|---|---|---|---|
| | A-3 | 867 | 827 | 11 | 530 | RECOMMENDED CONDITION |
| | A-4 | 890 | 850 | 8 | 550 | RECOMMENDED CONDITION |
| | A-5 | 840 | 800 | 21 | 510 | RECOMMENDED CONDITION |
| | A-6 | 885 | 845 | 7 | 670 | HIGHER THAN COOLING ENDING TEMPERATURE |
| B | B-1 | 890 | 850 | 7 | 510 | RECOMMENDED CONDITION |
| | B-2 | 885 | 845 | 15 | 497 | RECOMMENDED CONDITION |
| | B-3 | 885 | 845 | 13 | 535 | RECOMMENDED CONDITION |
| | B-4 | 875 | 835 | 21 | 520 | RECOMMENDED CONDITION |
| | B-5 | 870 | 830 | 9 | 550 | RECOMMENDED CONDITION |
| C | C-1 | 905 | 865 | 6 | 510 | RECOMMENDED CONDITION |
| | C-2 | 885 | 845 | 24 | 480 | RECOMMENDED CONDITION |
| | C-3 | 955 | 915 | 11 | 500 | RECOMMENDED CONDITION |
| | C-4 | 855 | 815 | 26 | 450 | RECOMMENDED CONDITION |
| | C-5 | 885 | 845 | 17 | 675 | HIGHER THAN COOLING ENDING TEMPERATURE |
| D | D-1 | 890 | 850 | 14 | 535 | RECOMMENDED CONDITION |
| | D-2 | 875 | 835 | 27 | 535 | RECOMMENDED CONDITION |
| | D-3 | 900 | 860 | 17 | 480 | RECOMMENDED CONDITION |
| | D-4 | 865 | 825 | 14 | 490 | RECOMMENDED CONDITION |
| E | E-1 | 875 | 835 | 11 | 510 | RECOMMENDED CONDITION |
| | E-2 | 885 | 845 | 29 | 530 | RECOMMENDED CONDITION |
| | E-3 | 890 | 850 | 2 | 495 | LESS THAN COOLING RATE |
| F | F-1 | 895 | 855 | 7 | 550 | RECOMMENDED CONDITION |
| G | G-1 | 885 | 845 | 12 | 540 | RECOMMENDED CONDITION |
| H | H-1 | 874 | 834 | 13 | 590 | RECOMMENDED CONDITION |
| I | I-1 | 888 | 848 | 9 | 555 | RECOMMENDED CONDITION |

TABLE 5

| STEEL TYPE | CLASSIFICATION | THICKNESS OF PRODUCT (mm) | AVERAGE GRAIN SIZE SURFACE LAYER (mm) | AVERAGE GRAIN SIZE ¼ t POINT (mm) | PHYSICAL PROPERTY YS (Mpa) | PHYSICAL PROPERTY TS (Mpa) | WEIGHT LOSS PER UNIT AREA ($g/cm^2$) |
|---|---|---|---|---|---|---|---|
| A | A-1 | 85 | 2.3 | 13.5 | 507 | 659 | 1.08 |
| | A-2 | 35 | 2.4 | 9.5 | 501 | 655 | 1.15 |
| | A-3 | 60 | 2.5 | 12.5 | 503 | 650 | 1.12 |
| | A-4 | 70 | 10.2 | 14.5 | 578 | 698 | 1.84 |
| | A-5 | 40 | 5.9 | 8.5 | 538 | 658 | 1.55 |
| | A-6 | 75 | 2.1 | 24.5 | 413 | 555 | 0.94 |
| B | B-1 | 90 | 2.5 | 11.5 | 504 | 661 | 1.11 |
| | B-2 | 45 | 3 | 12.5 | 499 | 656 | 1.19 |
| | B-3 | 60 | 2.5 | 11.5 | 498 | 652 | 1.13 |
| | B-4 | 40 | 10.2 | 9.5 | 582 | 674 | 1.85 |
| | B-5 | 80 | 5.6 | 13.5 | 529 | 652 | 1.51 |
| C | C-1 | 95 | 2.1 | 14.5 | 522 | 663 | 0.89 |
| | C-2 | 35 | 2.2 | 9.5 | 521 | 658 | 0.93 |
| | C-3 | 75 | 12.2 | 12.5 | 524 | 652 | 1.83 |
| | C-4 | 35 | 3.9 | 11.5 | 582 | 674 | 1.3 |
| | C-5 | 40 | 2.2 | 26.5 | 408 | 545 | 0.95 |
| D | D-1 | 65 | 2.4 | 11.5 | 554 | 682 | 1.01 |
| | D-2 | 35 | 2.6 | 9.5 | 621 | 720 | 1.12 |
| | D-3 | 60 | 10.4 | 10.5 | 585 | 687 | 1.85 |
| | D-4 | 45 | 5.9 | 11.5 | 561 | 678 | 1.52 |
| E | E-1 | 75 | 2.8 | 12.5 | 548 | 671 | 1.15 |
| | E-2 | 30 | 2.4 | 7.5 | 636 | 726 | 1.03 |
| | E-3 | 50 | 2.6 | 19.5 | 468 | 595 | 1.14 |
| F | F-1 | 70 | 8.7 | 15.5 | 498 | 635 | 1.63 |
| G | G-1 | 65 | 11.9 | 19.5 | 398 | 535 | 1.93 |
| H | H-1 | 50 | 7.4 | 13.5 | 463 | 650 | 1.5 |
| I | I-1 | 75 | 10.2 | 13.5 | 461 | 630 | 1.79 |

Steel types A, B, C, D, and E are steels satisfying the alloy compositions of the present disclosure. It can be seen that in A-1, A-2, A-3, B-1, B-2, B-3, C-1, C-2, D-1, D-2, E-1, and E-2 among the steel types, an average grain size of a surface layer portion is 3 μm or less, tensile strength is 570 MPa or more, and weight loss per unit area is 1.2 $g/cm^2$ or less.

In the case of A-4, B-4, C-3, and D-3 satisfying the alloy compositions of the present disclosure but having a heat recuperation temperature exceeding a range of the present disclosure, it can be seen that when an average grain size of a surface layer portion is greater than 3 μm, weight loss per unit area is greater than 1.2 $g/cm^2$. This is because the surface layer portion of the steel was heated to a temperature higher than a heat treatment temperature in a two-phase region to reversely transform an entire structure of the surface layer portion into austenite, so that a final structure of the surface layer portion was formed of lath bainite.

In the case of A-5, B-5, C-4, and D-4 satisfying the alloy compositions of the present disclosure but having a heat recuperation temperature lower than a range of the present disclosure, it can be seen that an average grain size of a surface layer portion exceeds 3 μm and weight loss per unit area is greater than 1.2 $g/cm^2$. This is because a surface layer portion of steel was excessively cooled during first cooling, so that reversely transformed austenite in the surface layer portion was insufficiently formed.

In the case of A-6 and C-5 satisfying the alloy composition of the present disclosure but having a cooling end temperature of second cooling lower than a range of the present disclosure or in the case of E-3 satisfying the alloy composition of the present disclosure but having a cooling rate of second cooling lower than a range of the present disclosure, it can be seen that tensile strength was at a level of less than 570 MPa, so that desired high-strength characteristic could not be secured.

In the case of F-1, G-1, H-1, and I-1 not satisfying the alloy composition of the present disclosure, it can be seen that an average grain size of a surface layer portion was greater than 3 μm even though the process conditions of the present disclosure are satisfied and tensile strength was at a level of less than 570 MPa, so that desired corrosion resistance and high-strength characteristics were not secured.

Accordingly, in the case of examples satisfying the alloy compositions and the process conditions of the present disclosure, it can be seen that weight loss per unit area was 1.2 $g/cm^2$, excellent corrosion resistance, and tensile strength was 570 MPa or more, so that high-strength characteristics could be secured.

While examples embodiments in the present disclosure have been described in detail, however, claims of the present disclosure are not limited thereto, and it will be apparent to those skilled in the art that various modifications and changes may be made without departing from the technological ideas of the present disclosure described in the claims.

The invention claimed is:

1. A steel for a structure having excellent corrosion resistance, the steel comprising, by weight percentage (wt %), carbon (C): 0.03 to 0.12%, silicon (Si): 0.01 to 0.8%, manganese (Mn): 1.6 to 2.4%, phosphorus (P): 0.02% or less, sulfur(S): 0.01% or less, aluminum (Al): 0.005 to 0.5%, niobium (Nb): 0.005 to 0.1%, boron (B): 10 ppm or less, titanium (Ti): 0.005 to 0.1%, nitrogen (N): 15 to 150 ppm, calcium (Ca): 60 ppm or less, and a balance of iron (Fe) and inevitable impurities, the steel further comprising at least one or two or more selected from the group consisting of, by wt %, chromium (Cr): 1.0% or less (including 0%), molybdenum (Mo): 1.0% or less (including 0%), nickel (Ni): 2.0% or less (including 0%), copper (Cu): 1.0% or less (including 0%), and vanadium (V): 0.3% or less (including 0%), wherein a corrosion index (CI) represented by Equation 1 is 3.0 or less, the steel comprising a surface layer portion, disposed externally on the steel, and a central portion, disposed internally in the steel, the surface layer portion and the central portion being microstructurally divided in a thickness direction of the steel, wherein the surface layer portion consists of a tempered bainite as a matrix structure, a fresh martensite as a second structure and a remainder of austenite, wherein the central portion consists of acicular ferrite as a matrix structure, wherein an average grain diameter of a microstructure of the surface layer portion is 3 μm or less (excluding 0 μm), wherein an average grain diameter of a microstructure of the central portion is 5 to 20 μm, and wherein weight loss per unit area in a general corrosion acceleration test based on ISO 14993 cyclic corrosion test (CCT) is 1.2 g/cm$^2$ or less, $$CI=26.01*[Cu]+3.88*[Ni]+1.20*[Cr]+1.49*[Si]+17.28*[P]-7.29*[Cu]*[Ni]-9.1*[Ni]*[P]-33.39*[Cu]^2 \quad \text{[Equation 1]}$$

where [Cu], [Ni], [Cr], [Si], and [P] refer to weight % of Cu, Ni, Cr, Si, and P, respectively, and refer to 0 when corresponding alloy composition is not included.

2. The steel of claim 1, wherein the surface layer portion comprises an upper surface layer portion, disposed on an upper side of the steel, and a lower surface layer portion disposed on a lower side of the steel, and wherein each of the upper surface layer portion and the lower surface layer portion is provided to have a thickness of 3 to 10% compared with a thickness of the steel.

3. The steel of claim 1, wherein the tempered bainite and the fresh martensite are included in the surface layer portion in a total fraction of 95 area % or more.

4. The steel of claim 1, wherein the austenite is included in the surface layer portion in a fraction of 5 area % or less.

5. The steel of claim 1, wherein tensile strength of the steel is 570 MPa or more.

* * * * *